United States Patent [19]

Cloutier

[11] 4,171,063

[45] Oct. 16, 1979

[54] CONTAINERS FOR PAINTS AND OTHER COATING MATERIALS

[76] Inventor: John G. Cloutier, 54 Common St., Saco, Me. 04072

[21] Appl. No.: 910,372

[22] Filed: May 30, 1978

[51] Int. Cl.[2] ..... B65D 39/00

[52] U.S. Cl. ..... 220/307

[58] Field of Search ..... 220/307, 356, 352

[56] References Cited

U.S. PATENT DOCUMENTS

| | | | |
|---|---|---|---|
| 1,022,074 | 4/1912 | Graham | 220/307 |
| 3,105,621 | 10/1963 | Francis | 220/307 X |
| 4,087,018 | 5/1978 | Tebbutt | 220/307 X |

*Primary Examiner*—George T. Hall

[57] ABSTRACT

A paint container has the mouth of its can below and inwardly of its rim and terminating in a bead and its cover formed with an upwardly opening marginal channel. The mouth and the outer wall of the channel include portions providing a continuous seal and a releasable interlock when the channel is seated in the mouth and the cover pressed into its closed position.

4 Claims, 3 Drawing Figures

CONTAINERS FOR PAINTS AND OTHER COATING MATERIALS

BACKGROUND REFERENCES

U.S. Pat. No. 3,817,420
U.S. Pat. No. 3,770,161
U.S. Pat. No. 3,744,671
U.S. Pat. No. 3,420,397
U.S. Pat. No. 3,362,565
U.S. Pat. No. 2,885,108
U.S. Pat. No. 2,443,984
U.S. Pat. No. 2,328,084
U.S. Pat. No. 1,091,612
U.S. Pat. No. 1,009,654

RELATED APPLICATION

Ser. No. 770,185, Filed Feb. 18, 1977

BACKGROUND OF THE INVENTION

Everyone who has done any painting is familiar with the fact that, in the use of a paint can, as excess paint is wiped from the brush by drawing it over the bead of the upwardly opening channel which is exposed within the can when the container is opened, paint is caught therein and, usually some of the paint runs down the outside of the can.

The upwardly opening rim channel serves to receive the depending portion of an upwardly opening channel at the margin of the cover which portion is dimensioned to be a press fit in the channel within the rim. Such a can and cover construction has proved otherwise satisfactory as providing an effectively sealed container when filled at the factory while enabling the cover to be pried free when its contents are to be used, although sometimes the resealing of the can is not easily or securely effected.

While many proposals have been made for other closure constructions, as far as I am aware, such have not been capable of meeting the use problems above referred to and have not been as satisfactory otherwise as the paint containers, the construction of which creates such problems.

THE PRESENT INVENTION

The general objective of the present invention is to provide containers for paints and other coating materials that can be spread with a brush and that meet the requirements of the container and paint manufacturers and virtually eliminate problems attendant their use by painters including both the resealing of the can and the waste of paint resulting from the necessary procedure of removing excess paint from the brushes as they are wiped across the beads of the channel exposed within the can.

In accordance with the invention, this objective is attained by providing each can with a mouth-defining flange below the rim of the can and disposed to prevent the accumulation of liquid thereon between the wall of the can and the inner margin of the flange. The cover has an upwardly opening, marginal channel of a depth greater than the distance between the rim of the can and the inner margin of the flange. The bottom of the channel is spaced inwardly of the margin of the flange and the outer channel wall is upwardly inclined and outwardly inclined. The outer wall is dimensioned to extend above the flange margin when the cover has been seated in the mouth of the can, the plane of the cover then in or below a plane inclusive of the rim of the can. The margin of the flange and a portion of the outer channel wall provide a mechanical but releasable interlock when the cover is sealed.

BRIEF DESCRIPTION OF THE DRAWINGS

In the accompanying drawings, preferred embodiments of the invention are illustrated and -

THE PREFERRED EMBODIMENT OF THE INVENTION

Figure 1:
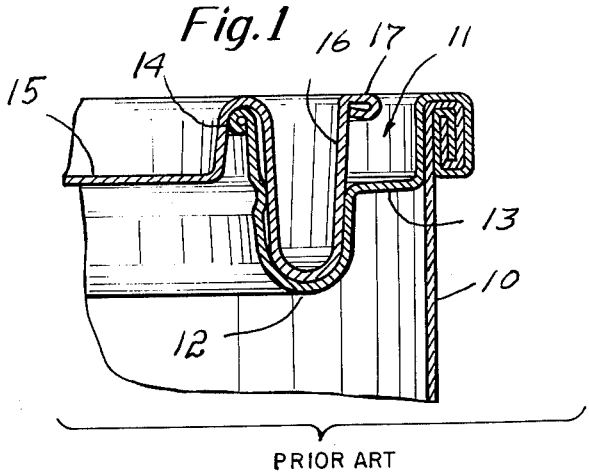
FIG. 1 is a section taken vertically through the rim of a paint container of the type currently in use.
Figure 2:
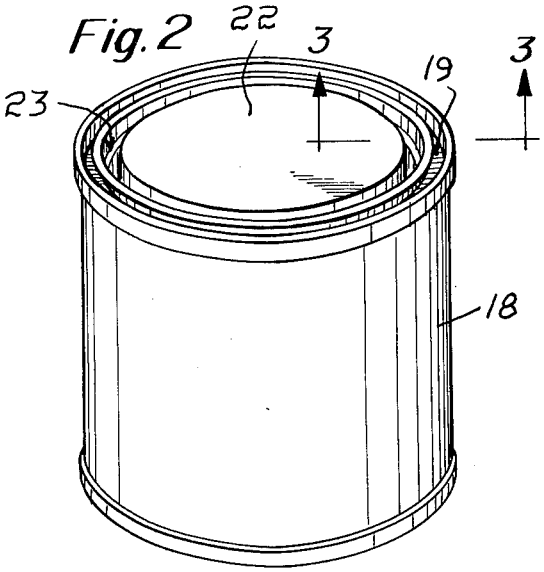
FIG. 2 is a perspective view of a paint container in accordance with the invention.
Figure 3:
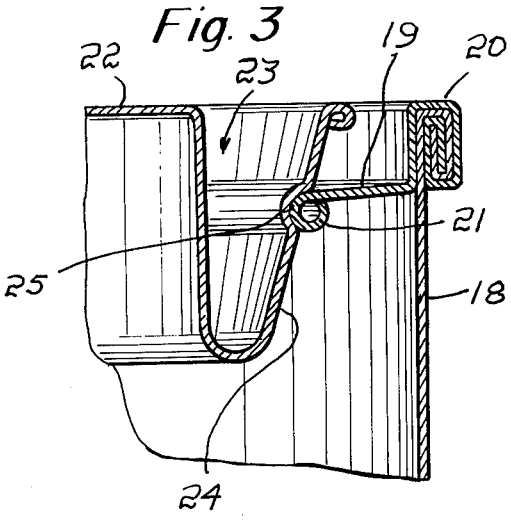
FIG. 3 is a section, on a substantial increase in scale, taken approximately along the indicated line 3—3 of FIG. 2.

In FIG. 1, a paint can 10 of the type widely used has a mouth 11 conventionally secured to its rim. The mouth 11 includes an upwardly opening channel 12 spaced from the wall of the can 10 by a shoulder 13 with the outer wall of the channel 12 terminating in a bead 14 in the plane of the rim. The can cover 15 has an upwardly opening marginal channel 16 shaped and dimensioned to be such a tight press fit in the channel 12 that the cover must be pried free when the can contents are to be used. The outer wall of the channel 16 terminates in a bead 17.

When a brush is dipped into the container, excess paint is removed by wiping the brush across the bead 14 with the channel 12 receiving paint in the process.

A paint container in accordance with the disclosed embodiment of the invention includes a can 18 and a mouth defined by a narrow flange 19 below the rim 20 of the can and conventionally secured thereto. The inner edge of the flange 19 terminates in a marginal bead 21 and, as shown, the flange 19 is downwardly and inwardly inclined for drainage purposes.

The can cover 22 includes an upwardly opening U-shaped channel 23 at its margin that is of sufficient depth so that when the cover 22 is in its seated or closed position, the bottom of the channel 23 is below the bead 21 and the channel 23 is so dimensioned that its outer wall 24 is a press fit in the mouth of the can. The outer wall 24 is outwardly and upwardly inclined and formed with a groove 25 located in an intermediate portion thereof to receive the bead 21 when the cover 22 is seated, the cover then in a plane inclusive of the rim of the can 18, or, if desired, it or the upper end of the wall 24 may be slightly below said rim.

While the cover 22 is thus positively connected to the can 18, it may be pried free as readily as the cover of a conventional can due to the width and depth of the channel 23. In this connection, it should be noted that the bottom of the groove is inwardly of the bead 21 and that the groove 25 is so formed that its upper margin is a well defined shoulder while its lower margin is sufficiently less abrupt due to the inclination of the wall 24 to facilitate the freeing of the cover 22 while the can is being pried open.

I claim:

1. A can and a cover therefor, said can including an internal, mouth-defining flange spaced below the rim of the can and disposed to prevent the accumulation of liquid thereon between the wall of the can and the inner margin of the flange, said cover including an upwardly opening marginal channel of a depth greater than the distance between said margin and the rim of the can, the bottom of said channel spaced inwardly of said margin and the outer wall of said channel inclined upwardly towards said rim resiliently yieldable, an intermediate portion of said outer channel wall including a portion dimensioned to frictionally engage and become mechanically but releasably interlocked to said flange margin whenever the cover has been seated in said mouth to bring the plane of the cover into a predetermined position such that it does not protrude above a plane inclusive of the rim of the can.

2. The can and cover of claim 1 in which the mouth-defining flange is downwardly and inwardly inclined.

3. The can and cover of claim 1 in which the sealing portion of the outer channel wall of the cover includes a groove and the margin of the flange is a groove-entering bead.

4. The can and cover of claim 3 in which the groove in the outer channel wall is in an intermediate portion thereof.

* * * * *